US006782874B1

(12) United States Patent
Matsumoto

(10) Patent No.: US 6,782,874 B1
(45) Date of Patent: Aug. 31, 2004

(54) ABNORMALITY DETECTING APPARATUS FOR FUEL EVAPORATIVE EMISSION CONTROL SYSTEM

(75) Inventor: Norio Matsumoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/658,196

(22) Filed: Sep. 10, 2003

(30) Foreign Application Priority Data

May 21, 2003 (JP) ..... 2003-143170

(51) Int. Cl.[7] ..... F02M 25/00

(52) U.S. Cl. ..... 123/520; 123/519; 123/198 D; 73/117.3; 73/118.1

(58) Field of Search ..... 123/516, 518–521, 123/198 D; 73/116, 117.2, 117.3, 118.1

(56) References Cited

U.S. PATENT DOCUMENTS 5,317,909 A * 6/1994 Yamada et al. ..... 73/118.1
5,327,873 A * 7/1994 Ohuchi et al. ..... 123/520
5,477,842 A * 12/1995 Maruyama et al. ..... 123/690
5,699,775 A * 12/1997 Azuma ..... 123/520
5,731,514 A * 3/1998 Miwa et al. ..... 73/118.1
5,758,628 A 6/1998 Wada
6,321,728 B1 * 11/2001 Ohkuma ..... 123/520
6,564,781 B2 5/2003 Matsumoto et al.

FOREIGN PATENT DOCUMENTS

JP 11-229985 A 8/1999
JP 11-324828 A 11/1999
JP 2002-357163 A 12/2002

* cited by examiner

*Primary Examiner*—Weilun Lo
(74) *Attorney, Agent, or Firm*—Sughrue Mion, PLLC

(57) ABSTRACT

Provided is a more reliable abnormality detecting apparatus for a fuel evaporative emission control system, including: a canister provided to a purge passage; a purge control valve; a control unit for opening/closing the purge valve depending on an operation state; a unit detecting an air intake pipe pressure; a unit detecting an atmospheric pressure; a unit detecting at least one of a fuel temperature, a tank internal temperature, and an outside air temperature; a unit detecting a fuel tank pressure; a unit adjusting a purge amount depending on the air intake pipe pressure, when an abnormality decision enabling condition is valid; a unit detecting abnormality based on the fuel tank pressure, when abnormality decision enabling condition is valid; an abnormality decision enabling condition detecting unit for determining that the abnormality decision enabling condition is invalid when at least one of the fuel temperature, the tank internal temperature, and the outside air temperature is greater than its comparison reference value.

5 Claims, 9 Drawing Sheets

FIG. 12

| | | | | |
|---|---|---|---|---|
| ATMOSPHERIC PRESSURE PA[$KP_2$] | 70 | | 95 | 101 |
| COMPARISON REFERENCE VALUE TTMON[℃] | 35 | | 42 | 45 |

FIG. 13

| | | | | |
|---|---|---|---|---|
| ATMOSPHERIC PRESSURE PA[$KP_2$] | 70 | | 95 | 101 |
| COMPARISON REFERENCE VALUE DTTMON[℃] | 1 | | 3 | 3 |

ABNORMALITY DETECTING APPARATUS FOR FUEL EVAPORATIVE EMISSION CONTROL SYSTEM

BACKGROUND OF THE INVENTION

1. Field of the Invention

The present invention generally relates to a fuel evaporative emission control system for preventing evaporative emission of fuel gas which is produced within a fuel tank of an internal combustion engine. More particularly, the present invention relates to an abnormality detecting apparatus for detecting occurrence of abnormality such as leak of fuel gas in the fuel evaporative emission control system.

2. Description of the Related Art

In general, in the internal combustion engine for motor vehicles or the like, it is statutorily imposed to equip the engine with a fuel evaporative emission control system with the aim of preventing evaporative emission of the fuel gas produced within a fuel tank to the atmosphere.

The fuel evaporative emission control system of the type known heretofore is composed of a sensor unit for detecting operation states of the internal combustion engine (such as rotation speed and a load state of the engine), a purge passage for communicating the fuel tank provided for supplying the fuel to the engine and an intake pipe thereof with each other, and a canister disposed in the purge passage at an intermediate location thereof.

The canister adopted for adsorbing the fuel gas produced within the fuel tank has an atmospheric air port which can be opened to the atmosphere, and a purge control valve is disposed at an intermediate location between the canister and the intake pipe of the engine. An adsorbent disposed within the canister adsorbs the fuel gas on the way of flowing through the purge passage which communicates the fuel tank and the intake pipe with each other.

Further, the fuel evaporative emission control system includes a fuel evaporative emission control unit (constituted by a microcomputer) for controlling opening/closing operation of the purge control valve in dependence on the operation states of the internal combustion engine in order to sustain the fuel gas adsorbing function of the canister by preventing the adsorbent from becoming saturated.

The fuel evaporative emission control unit is so designed as to control opening/closing of the purge control valve in dependence on the operation states of the internal combustion engine for causing the fuel gas adsorbed by the canister to be discharged into the intake pipe such that the fuel gas is mixed with the mixture of air and fuel. In this manner, the evaporative emission of the fuel can be prevented.

Typically, the above-mentioned fuel evaporative emission control system is provided with an abnormality detecting apparatus for detecting closure of an atmospheric air port of a canister, inability to open a purge control valve, damage to a purge passage on a side of an air intake pipe, and other such abnormalities in the fuel evaporative emission control system, based on a fuel tank pressure (see, for example, JP 2002-357163 A).

In accordance with this abnormality detecting apparatus for detecting the abnormality in the fuel evaporative emission control system, the detection of leak abnormality in the fuel evaporative emission control system is prohibited, depending on a concentration of fuel gas which is generated at the fuel tank, adsorbed by the canister, and made to flow into the air intake pipe due to opening control of the purge valve. Thus, the abnormality detection precision is increased.

However, the fuel gas concentration is detected based on a purge air amount introduced into the air intake pipe from the canister by the opening control of the purge valve before performing the abnormality decision, and an operation state including an air-fuel ratio feedback signal. Therefore, the purge valve is closed to put the tank in a hermetically sealed state, and thus the influence on the fuel tank pressure due to a change in the fuel gas concentration in the abnormality decision processing is not considered. This causes a fear of deterioration of the abnormality detection performance and an erroneous detection.

Further, even with the same fuel temperature, the tendency of occurrence of the fuel evaporative emission inside the fuel tank varies depending on influence from an atmospheric pressure, even under the same fuel temperature, tank interior temperature, and external atmospheric temperature. Therefore, there is a fear of deterioration of the abnormality detection performance and the erroneous detection.

As described above, in the conventional abnormality detecting apparatus for a fuel evaporative emission control system, the purge valve is closed and the tank is set in the hermetically sealed state, and the influence of the fuel tank pressure during the processing of performing the abnormality decision is not considered. Therefore, due to differences in each environmental condition and the like, there is an adverse effect on the abnormality detection. Ultimately, there is a problem in that the abnormality detection cannot be made accurately.

SUMMARY OF THE INVENTION

The present invention has been made to solve the above-mentioned problems, and therefore has as an object to provide an abnormality detecting apparatus for a fuel evaporative emission control system, in which reliability is improved by setting a prohibition condition decision value for at least one of a fuel temperature, a tank internal temperature, and an external atmospheric temperature.

According to the present invention, an abnormality detecting apparatus for detecting abnormality in a fuel evaporative emission control system includes: a sensor unit for detecting operation states of an internal combustion engine; a canister disposed at an intermediate location of a purge passage communicating a fuel tank providing fuel to the internal combustion engine and an air intake pipe of the internal combustion engine with each other, for adsorbing fuel gas generated in the fuel tank; an atmospheric air port provided to the canister and opened to an atmosphere side; a purge valve disposed at an intermediate position between the canister and the air intake pipe; and a fuel evaporative emission control unit for preventing the evaporative emission of the fuel by controlling opening/closing of the purge valve depending on the operation state of the internal combustion engine and introducing fuel gas adsorbed by the canister into the air intake pipe as occasion requires.

Further, the sensor unit includes: one of an intake air amount detecting unit for detecting an intake air amount as a load state of the internal combustion engine, and an intake air pipe pressure detecting unit for detecting an intake air pressure and an atmospheric pressure detecting unit for detecting an atmospheric pressure; at least one of an outside air temperature detecting unit for detecting an outside air temperature, a fuel temperature detecting unit for detecting a fuel temperature inside the fuel tank, and a tank internal temperature detecting unit for detecting a gas temperature inside the fuel tank; and a fuel tank pressure detecting unit for detecting a pressure within the fuel tank as a fuel tank pressure.

Further, the fuel evaporative emission controlling unit includes: an atmospheric air port closing unit for closing the atmospheric air port; a hermetically closing unit for hermetically closing both the purge control valve and the and the atmospheric air port to thereby put the overall fuel evaporative emission control system in a hermetically sealed state; an abnormality decision enabling condition detecting unit for detecting validity of an abnormality decision enabling condition of the fuel evaporative emission control system, based on the operation state of the internal combustion engine; a purge rate adjusting unit for regulating a purge rate by controlling an opening degree of the purge control valve depending on the air intake pipe pressure when the abnormality decision enabling condition is valid; and an abnormality detecting unit for detecting an abnormality of the fuel evaporative emission control system, based on the fuel tank pressure at the time when the abnormality decision enabling condition is valid.

Further, the abnormality decision enabling condition detecting unit includes a condition validation limiting unit for prohibiting the abnormality decision, in dependence on at least one of the fuel temperature, the tank internal temperature, and the outside air temperature.

BRIEF DESCRIPTION OF THE DRAWINGS

In the accompanying drawings:

FIG. 12 is an explanatory diagram showing a comparison reference value for a fuel temperature, which is set changeably in dependence on the atmospheric pressure, according to Embodiment 6 of the present invention; and FIG. 13 is an explanatory diagram showing a comparison reference value for a fuel temperature change amount, which is set changeably according to the atmospheric pressure, according to Embodiment 6 of the present invention.

DETAILED DESCRIPTION OF THE PREFERRED EMBODIMENTS

Embodiment 1

Figure 1:
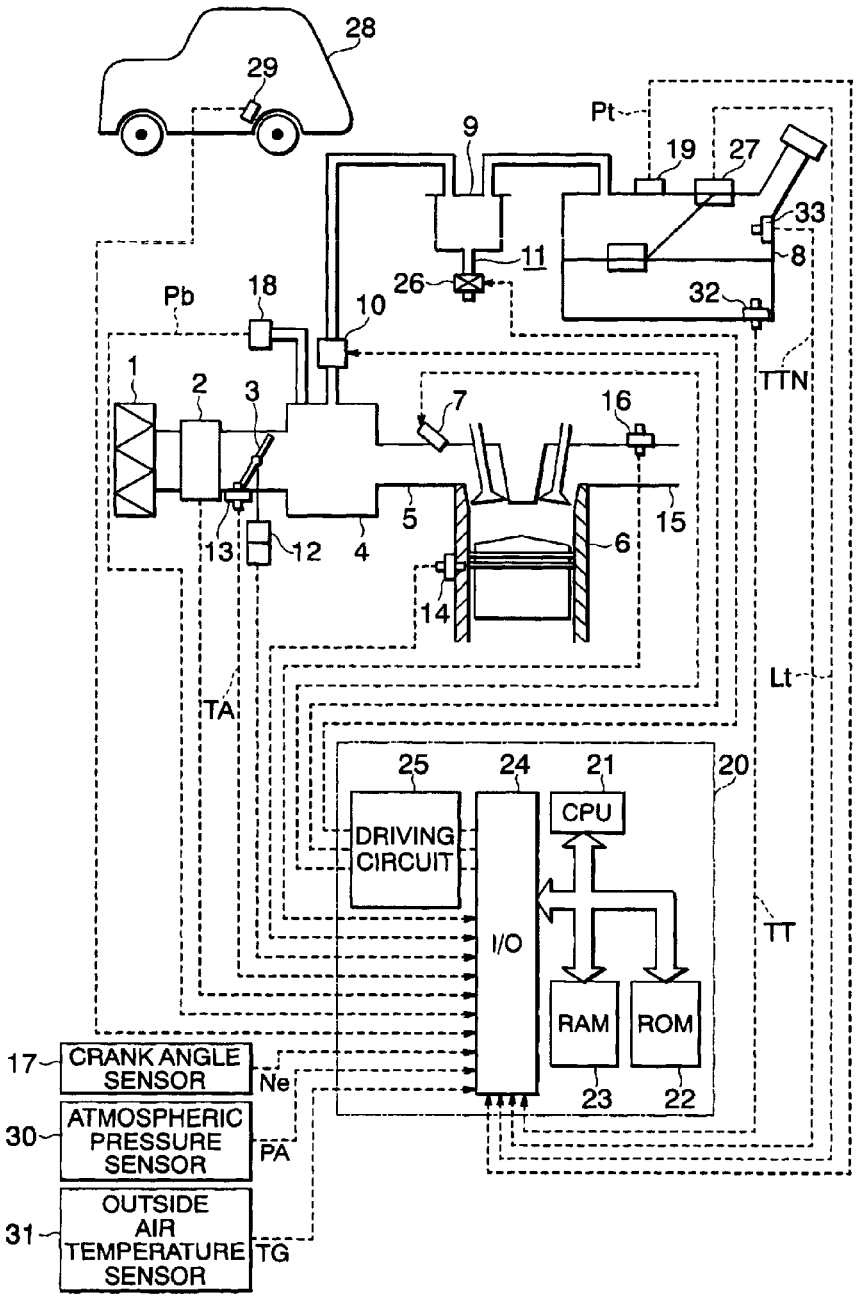
FIG. 1 is a block constructional diagram showing Embodiment 1 of the present invention.

Hereinafter, Embodiment 1 of the present invention will be described in detail with reference to the drawings. FIG. 1 is a block constructional diagram showing an abnormality detecting apparatus in a fuel evaporative emission control system according to Embodiment 1 of the present invention. Referring to FIG. 1, air sucked through an air cleaner 1 is fed to individual cylinders of an engine 6 which constitutes a main body of the internal combustion engine system by way of an intake pipe 5 which is equipped with an air flow sensor 2, a throttle valve 3, and a surge tank 4.

The air flow sensor 2 is designed to measure the rate of intake air flow fed to the engine 6 through the intake pipe 5. The output signal of the air flow sensor 2 indicating the intake air flow rate as measured is supplied to an electronic control unit (hereinafter, referred to as the ECU in abbreviation) 20. The throttle valve 3 serves to adjust the intake air flow fed to the engine 6 in dependence on the depression stroke of an accelerator pedal (not shown).

The intake pipe 5 is further equipped with a fuel injector 7 for injecting an amount of fuel into the intake pipe 5. To this end, a fuel tank 8 for supplying the fuel to the internal combustion engine 6 is provided. The fuel tank 8 is placed in communication with the fuel evaporative emission control system which is provided in association with various-types of sensor units.

The sensor units mentioned above are destined for detecting the operation states of the engine 6, (for example, engine rotation speed: rotation number Ne, and a load state: charging efficiency Ec). As the sensor units, there can be enumerated the air flow sensor 2, a throttle position sensor 12, an intake-air temperature sensor 13, a water temperature sensor 14, an air-fuel ratio sensor (O2-sensor) 16, a crank angle sensor 17, an intake pressure sensor 18, a fuel tank pressure sensor 19, a fuel level gauge 27, a vehicle speed sensor 29, an atmospheric pressure sensor 30, an outside air temperature sensor 31, a fuel temperature sensor 32, and a tank internal temperature sensor 33.

The throttle position sensor 12 is mounted on a rotatable shaft of the throttle valve 3 for detecting the opening degree thereof while the intake-air temperature sensor 13 is provided in association with the intake pipe 5 for detecting the temperature of the intake air The water temperature sensor 14 serves to detect the temperature of cooling water for the engine 6. The air-fuel ratio sensor 16 is provided in association with an exhaust pipe 15 of the engine 6 for generating an air-fuel ratio feedback signal.

The crank angle sensor 17 is designed to generate a crank angle signal representative of the rotation speed (rotation number Ne) of the engine 6. The intake pressure sensor 18 is provided in association with the surge tank 4 of the intake pipe 5 for detecting an intake pressure Pb prevailing within the intake pipe 5. The fuel tank pressure sensor 19 is provided in association with the fuel tank 8 to detect a fuel tank pressure Pt, while the fuel level gauge 27 serves to detect a level Lt of the fuel contained in the fuel tank 8.

The vehicle speed sensor 29 is installed at a location close to an axle of the motor vehicle 28 which is equipped with the engine 6 and serves for detecting the speed of the motor vehicle 28. The atmospheric pressure sensor 30 is designed to detect the outside air pressure as an atmospheric pressure PA, while the outside air temperature sensor 31 is designed to detect an outside air temperature TG. On the other hand, the fuel temperature sensor 32 is dedicated for detecting a temperature TT of the fuel contained in the fuel tank 8, and the tank internal temperature sensor 33 is dedicated for detecting a temperature TTN inside the fuel tank 8. The detection signals outputted from the various sensor units mentioned above are outputted to the ECU 20 as the information signals indicative of the operation states of the engine.

The fuel evaporative emission control system includes a canister 9 installed in a purge passage, a purge control valve 10 disposed intermediately between the canister 9 and the intake pipe 5, and a fuel evaporative emission control unit (incorporated in the ECU 20) for preventing evaporative emission of the fuel by controlling opening/closing operation of the purge control valve 10.

The fuel tank 8 and the intake pipe 5 are placed in communication through the purge passage. The canister 9 accommodates therein activated carbon as an adsorbent and is disposed at an intermediate location of the purge passage for adsorbing the fuel gas generated within the fuel tank 8. The canister 9 is provided with an atmospheric air port 11 which can be opened to the atmosphere through an air port control valve 26. The air port control valve 26 constitutes an air port blocking unit in cooperation with the ECU 20. In other words, the atmospheric air port 11 is opened or closed by means of the air port control valve 26 under the control of the ECU 20.

More specifically, the fuel evaporative emission control unit incorporated in the ECU 20 is so designed as to control the opening/closing operation of the purge control valve 10 in dependence on the operation states of the engine 6 for the purpose of preventing the evaporative emission of the fuel gas adsorbed by the canister 9 by introducing the fuel gas into the intake pipe 5 as occasion requires. More specifically, the fuel evaporative emission control unit is so designed as to open the purge control valve 10 on the basis of a purge valve control quantity (i.e., duty control quantity corresponding to the purge rate) which is determined in dependence on the operation states of the engine 6 for thereby causing the fuel gas adsorbed by the canister 9 to be purged into the intake pipe 5 under the effect of the negative pressure prevailing within the intake pipe 5.

In that case, the air introduced into the canister 9 through the atmospheric air port 11 opened by means of the air port control valve 26 is purged into the intake pipe 5 as the air (purge air) for carrying the fuel gas desorbed from activated carbon when the air is caused to pass through the adsorbent such as activated carbon accommodated in the canister 9.

The ECU 20 is constituted by a microcomputer which includes a CPU 21, a ROM 22, a RAM 23, and others for carrying out various controls such as air-fuel ratio control and ignition timing control for the engine 6. An input/output interface 24 incorporated in the ECU 20 is designed to fetch the signals from the various-types of sensor units mentioned above as the detection information and output control signals to various types of actuators through a driving circuit 25.

More specifically, the CPU 21 incorporated in the ECU 20 performs arithmetic operation for the air-fuel ratio feedback control in accordance with a control program on the basis of various maps stored in the ROM 22 to thereby control operation of the fuel injector 7 by way of the driving circuit 25.

Further, the ECU 20 performs the control of opening/closing operations of the purge control valve 10 and the air port control valve 26 in addition to the conventional engine controls such as the ignition timing control, the exhaust gas recirculation (EGR) control, and the idling rotation speed control for the engine 6 in dependence on the operation states thereof.

Furthermore, the ECU 20 includes a fuel-gas concentration detecting unit for detecting the concentration of the fuel gas introduced into the intake pipe from the canister. The fuel-gas concentration detecting unit is so designed as to arithmetically determine the concentration of the fuel gas contained in the purge air on the basis of the flow rate or quantity of the purge air fed to the engine 6 and the air-fuel ratio feedback signal indicating the engine operation state.

Additionally, the ECU 20 includes an air port blocking unit for controlling the air port control valve 26 to thereby close the atmospheric air port 11, a hermetically closing unit for closing both the purge control valve 10 and the atmospheric air port 11 to thereby place the fuel evaporative emission control system as a whole in the hermetically closed state, and an abnormality decision enabling condition detecting unit for detecting validity of the conditions for the decision as to occurrence of abnormality in the fuel evaporative emission control system on the basis of the engine operation state.

Moreover, the ECU 20 includes a purge rate regulating unit for adjusting the purge rate by controlling the opening degree of the purge control valve 10 by taking into account the intake pressure Pb when the abnormality decision enabling conditions are validated, and an abnormality detecting unit for detecting abnormality of the fuel evaporative emission control system on the basis of the fuel tank pressure Pt which exhibits dependency on the purge rate when the abnormality decision enabling conditions are validated.

The abnormality decision enabling condition detecting unit incorporated in the ECU 20 includes a condition validation limiting unit for limiting the validation of the abnormality detection enabling conditions. The condition validation limiting unit is so designed as to prohibit an abnormal determination in dependence on at least one of the fuel temperature TT, the tank internal temperature TTN, and the outside air temperature TG.

Figure 2:
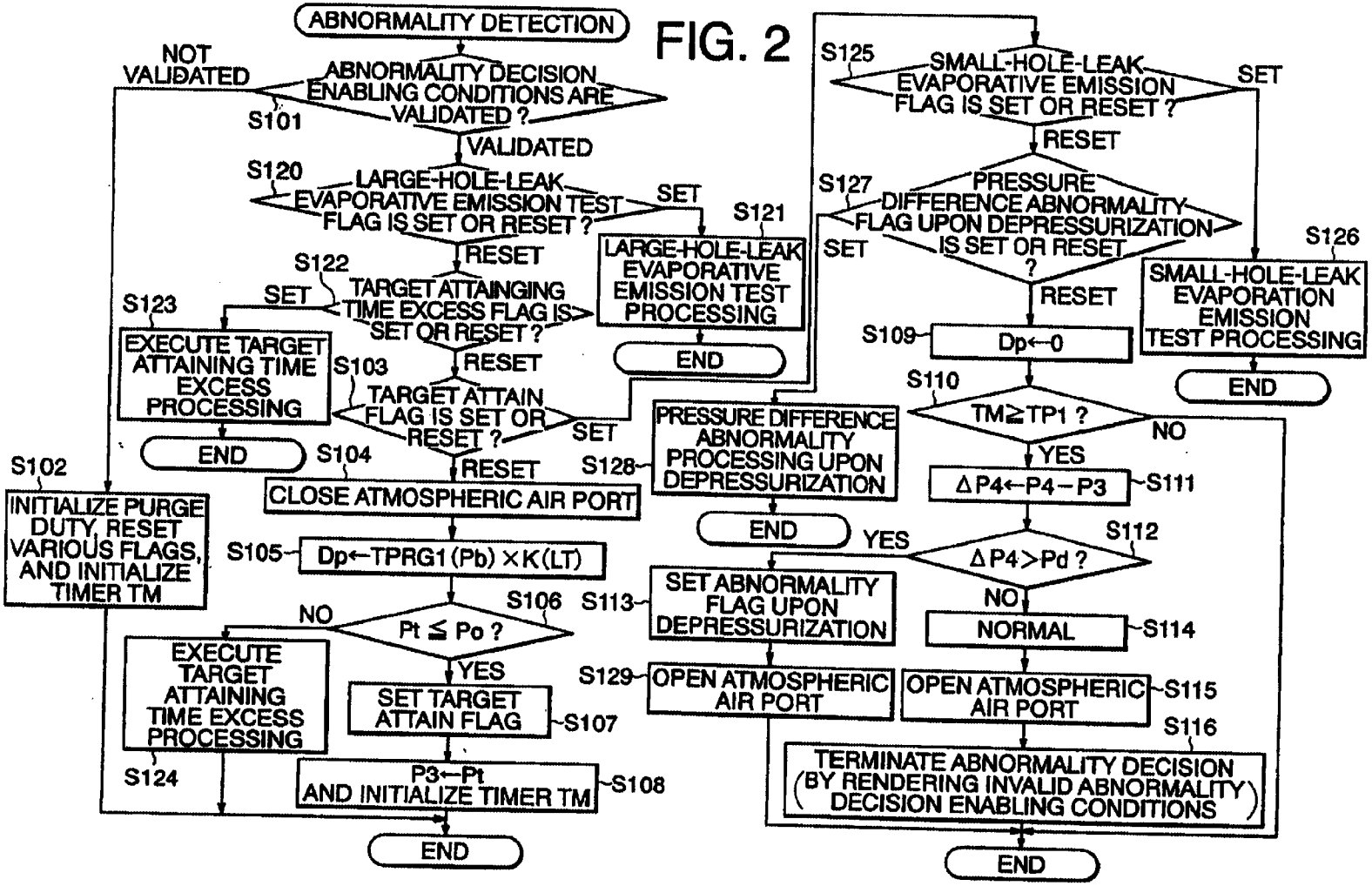
FIG. 2 is a flow chart showing processing operations according to Embodiment 1 of the present invention.

Now, referring to a flow chart shown in FIG. 2, description will generally be made of the abnormality detecting operation according to Embodiment 1 of the present invention shown in FIG. 1. FIG. 2 shows a processing routine as a whole which is executed by the ECU 20. This processing routine is called periodically at a predetermined time interval for execution.

Referring to FIG. 2, decision is first made as to whether or not the current operation state of the internal combustion engine satisfies abnormality decision enabling conditions (step S101). When the operation state does not satisfy the abnormality decision enabling conditions (i.e., if NO), various parameters are initialized with various flags being reset (step S102), and the processing routine shown in FIG. 2 is terminated.

In the initialization step S102, the ECU 20 sets a purge duty Dp for the purge control valve 10 to a map value determined in dependence on the engine rotation number Ne and the charging efficiency Ec (which is arithmetically determined from the engine rotation number Ne and the intake air flow).

Further, a timer TM is initialized (TM=0) at step S102. This timer MT is designed for measuring a time lapse in the course of purging operation with the atmospheric air port 11 being closed (i.e., in the course of lowering of the fuel tank pressure Pt to the negative pressure level or depressurization), a hermetic closure time period after the fuel tank pressure Pt has attained a target pressure level Po (i.e., the time period after the fuel tank pressure Pt has attained the target pressure level Po on the negative side), and a hermetic closure time period from a time point at which the fuel tank pressure is close to the atmospheric pressure.

Furthermore, the air port control valve 26 is driven to open the atmospheric air port 11 of the canister 9. Additionally, a target attain flag and a target attaining time excess flag for the fuel tank pressure Pt, a large-hole-leak evaporative emission test flag and a small-hole-leak evaporative emission test flag, and a pressure difference abnormality flag for depressurization are all reset.

On the other hand, when decision is made at step S101 that the engine operation state satisfies the abnormality decision enabling conditions (i.e., if YES), the state of the large-hole-leak evaporative emission test flag is checked (step S120). When it is decided at step S120 that the large-hole-leak evaporative emission test flag is set, a large-hole-leak evaporative emission test processing is carried out (step S121), and the processing routine shown in FIG. 2 is terminated.

By contrast, when it is decided at step S120 that the large-hole-leak evaporative emission test flag is reset, decision is then made as to whether or not the target attaining time excess flag for the fuel tank pressure Pt is set (step S122). When the decision at step S122 results in that the target attaining time excess flag is set, then the processing to be executed when the time taken for the fuel tank pressure to reach the target level becomes excessive is executed (step S123), and the processing routine shown in FIG. 2 is terminated.

On the other hand, when it is decided at step S122 that the target attaining time excess flag is reset (i.e., when it is decided that the time taken for attaining the target fuel tank pressure level is not exceeded), decision is then made as to the state of the target attain flag (step S103). More specifically, at step S103, decision is made as to whether or not the fuel tank pressure Pt detected by the fuel tank pressure sensor 19 has ever reached or attained the desired or target pressure level Po.

When the decision at step S103 results in that the target attain flag is reset (indicating that the fuel tank pressure Pt has not yet reached the target pressure level Po), the air port control valve 26 is closed to thereby block the atmospheric air port 11 of the canister 9 (step S104).

Additionally, the purge duty Dp is set to a value TPRG1 (Pb) mapped on the basis of the intake pressure Pb (step S105). In that case, the purge duty Dp is corrected by a correcting coefficient K (Lt) which bears dependency on the fuel level Lt in accordance with the following expression:

$$Dp=TPRG(Pb)\times K(Lt)$$

Subsequently, decision is made as to whether or not the fuel tank pressure Pt has attained the desired or target pressure level Po (step S106). When it is decided at step S106 that the fuel tank pressure Pt is higher than the target pressure level Po (i.e., if NO), the target attaining time excess processing is carried out (step S124), and the processing routine shown in FIG. 2 is terminated.

By contrast, when it is decided at step S106 that the fuel tank pressure Pt is equal to or lower than the target pressure level Po (i.e., if YES), the target attain flag is set (step S107). Subsequently, the fuel tank pressure Pt at this time point is stored as a value "P3", the timer TM is initialized (TM=0) (step S108), and the processing routine shown in FIG. 2 is terminated. Note that, here it is presumed that the timer TM is constantly incremented after the fuel tank pressure Pt has attained the target pressure level Po although illustration is omitted.

On the other hand, when it is decided at step S103 that the target attain flag is set (indicating that the fuel tank pressure Pt has already attained the target pressure level Po), then decision is made as to the state of the small-hole-leak evaporative emission test flag (step S125). When it is decided at step S125 that this flag is set, a small-hole-leak evaporative emission test processing is carried out (step S126), and the processing routine shown in FIG. 2 is terminated.

By contrast, when it is decided at step S125 that the small-hole-leak evaporative emission test flag is reset, then decision is made as to the state of the pressure difference abnormality flag which is associated with the depressurization (step S127). When it is decided that the pressure difference abnormality flag is set, the pressure difference abnormality processing upon depressurization is executed (step S128), and the processing routine shown in FIG. 2 is terminated.

Furthermore, when decision made at step S127 results in that the pressure difference abnormality flag associated with depressurization is reset, the purge duty Dp is set to zero (DP=0) (step S109) with the fuel gas being prevented from flowing into the surge tank 4. Thus, the fuel evaporative emission control system is placed in the hermetically closed state.

Subsequently, decision is made as to whether or not the timer TM has reached a predetermined time TP1 (step S110). When it is decided that TM<TP1 (i.e., if NO), this means that the predetermined time TP1 has not lapsed yet from the time point at which the fuel tank pressure Pt attained the target pressure level Po with the fuel evaporative emission control system being hermetically closed. Accordingly, the processing routine shown in FIG. 2 is immediately terminated.

On the other hand, when it is decided at step S110 that TM≧TP1 (i.e., if YES), this means that a time equal to or longer than the predetermined time TP1 has lapsed from the time point at which the fuel evaporative emission control system was hermetically closed after the fuel tank pressure Pt attained the target pressure level Po. Thus, a tank pressure difference ΔP4 between the current fuel tank pressure Pt (=P4) (i.e., the fuel tank pressure after the lapse of the predetermined time TP1) and the preceding fuel tank pressure P3 (i.e., the fuel tank pressure at the time point when the time measurement was started) is arithmetically determined (step S111).

Subsequently, decision is made as to whether or not the tank pressure difference ΔP4 is greater than an abnormal pressure difference Pd (step S112). When it is decided at step S112 that ΔP4>Pd (i.e., if YES), an abnormality flag associated with the depressurization is set (step S113), then the atmospheric air port 11 of the canister 9 is opened (step S129), and the processing routine shown in FIG. 2 is immediately terminated.

By contrast, when it is decided at step S112 that ΔP4≦Pd (i.e., if NO), it is then determined that the normal state prevails (step S114), and the atmospheric air port 11 of the canister 9 is opened (step S115) with the abnormality decision being disabled (i.e., abnormality decision enabling conditions being rendered constantly invalid) (step S116). Then, the processing routine shown in FIG. 2 is terminated.

Next, referring to FIGS. 3 to 9, specific description will be made of the processing steps S101, S121, S123, S124, S126, and S128 shown in FIG. 2. In the first place, referring to FIGS. 3 and 4, description will be made of the processing for deciding the validity of the abnormality decision enabling conditions (step S101 in FIG. 2).

Figure 3:
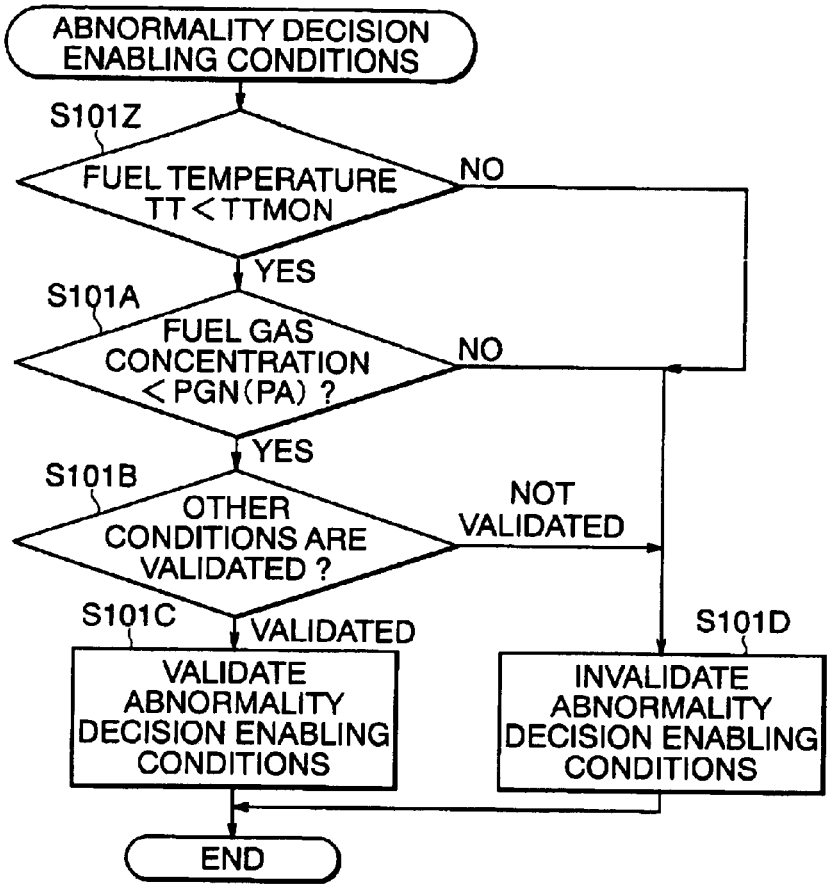
FIG. 3 is a flow chart specifically showing abnormality decision enabling condition processing (step S101) shown in FIG. 2.

FIG. 3 is a flow chart specifically showing the abnormality condition validity decision step S101. In FIG. 3, the fuel temperature TT detected by the fuel temperature sensor 32 provided inside the fuel tank 8, is first compared with the comparison reference value TTMON, to determine whether or not the fuel temperature is less than the comparison reference value TTMON (step S101Z).

At step S101Z, if it is determined that the fuel temperature TT is equal to or greater than the comparison reference value TTMON (i.e., if NO), then the procedure advances to step S101D for determining whether the abnormality decision enabling conditions are not validated, and the processing routine shown in FIG. 3 is terminated.

Further, at step S101Z, if it is determined that the fuel temperature TT is less than the comparison reference value TTMON (i.e., if YES), then the procedure advances to step S101A for determining whether the other conditions are validated.

At step S101A, the purge air fuel gas concentration calculated based on the operation state is compared with the comparison reference value PGN (PA), to determine whether or not the fuel gas concentration is less than the comparison reference value PGN (PA). In this case, the comparison reference value PGN (PA) for the fuel gas concentration, is set in dependence on the atmospheric pressure PA detected from the atmospheric pressure sensor 30. If it is determined that the fuel gas concentration is equal to or greater than the comparison reference value PGN (PA) (i.e., if NO), then the procedure advances to step S101D for determining whether the abnormality decision enabling conditions are not validated, and the processing routine shown in FIG. 3 is terminated.

Further, at step S101A, if it is determined that the fuel gas concentration is less than the comparison reference value PGN (PA) (i.e., if YES), then the procedure advances to step S101B for determining whether other conditions are validated. The other conditions are checked, and if it is determined that the conditions are not valid, then the procedure advances to step S101D for determining whether the abnormality decision enabling conditions are validated, and the processing routine shown in FIG. 3 is terminated. On the other hand, if it is determined that the conditions are valid, then the procedure advances to step S101C for determining whether the abnormality decision enabling conditions are validated, and the processing routine shown in FIG. 3 is terminated.

Accordingly, it is determined that if the fuel is readily evaporative and the fuel temperature TT, which is easy to influence the pressure inside the fuel tank 8, is high, the abnormality decision enabling conditions are validated, and the abnormality examination is prohibited. Therefore, the possibility of the erroneous abnormality detection is decreased, and the detection precision in the examination can be increased.

Figure 4:
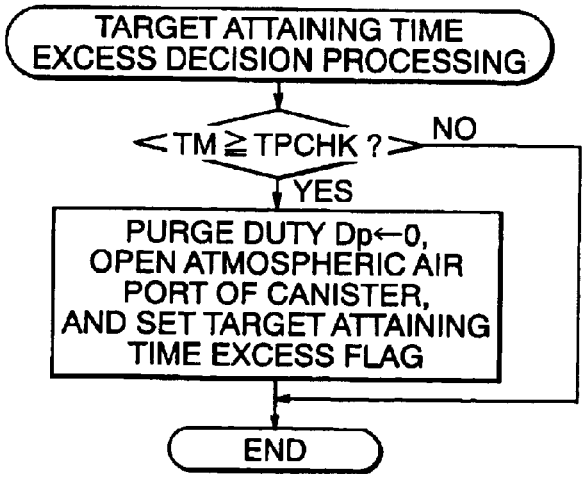
FIG. 4 is a flow chart specifically showing processing for determining elapse of a time duration before reaching a target (step S124) shown in FIG. 2.

Next, referring to FIG. 4, description will be made of the target attaining time excess decision processing (step S124 in FIG. 2). Referring to FIG. 4, the time lapsed from the time point at which the purged fuel was introduced by closing the atmospheric air port 11 in the state where the fuel tank pressure Pt is close to the atmospheric pressure PA is checked by making decision as to whether or not the timer TM indicates that a predetermined check time TPCHK has already passed (Step S124A).

When it is decided at step S124A that TM<TPCHK (i.e., if NO), indicating that the predetermined check time TPCHK has not lapsed yet, the processing routine shown in FIG. 4 is immediately terminated.

On the other hand, when the decision at step S124A shows that TM≧TPCHK (i.e., if YES), this means that the fuel tank pressure Pt has not reached or attained the target pressure level Po on the negative pressure side over an extended time period despite the closure of the atmospheric air port 11. In this case, it can be then regarded that the probability of occurrence of the large-hole-leak abnormality is high. Accordingly, preparation is made for the large-hole-leak evaporative emission test.

More specifically, at step S124A, the purge duty Dp is set to "0" (zero) with the purge control valve 10 being closed. At the same time, the atmospheric air port 11 of the canister 9 is opened to thereby allow the fuel tank pressure Pt to be increased or restored to the atmospheric pressure PA. Additionally, the target attaining time excess flag is set (step S124B) for indicating that the pressure Pt within the fuel tank 8 does not reach the target pressure Po notwithstanding that the time exceeding the timer value has elapsed, and the processing routine shown in FIG. 4 is terminated.

Figure 5:
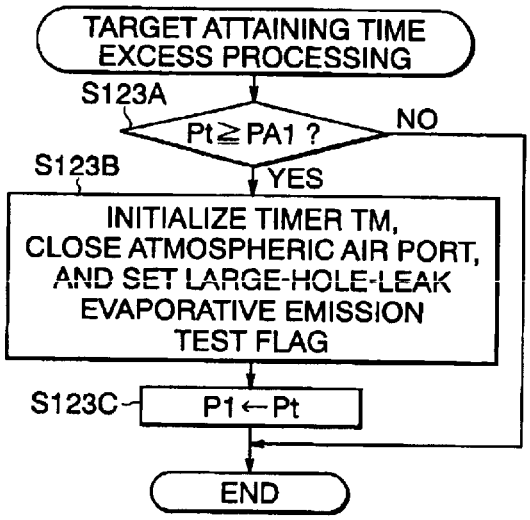
FIG. 5 is a flow chart specifically showing time period elapse time processing (step S123) shown in FIG. 2.

Next, referring to a flow chart shown in FIG. 5, description will be made of the time excess processing of FIG. 2 (step S123). Referring to FIG. 5, decision is first made as to whether or not the fuel tank pressure Pt has attained a restored pressure level PA1 (which is preset close to the atmospheric pressure PA) (step S123A).

Figure 6:
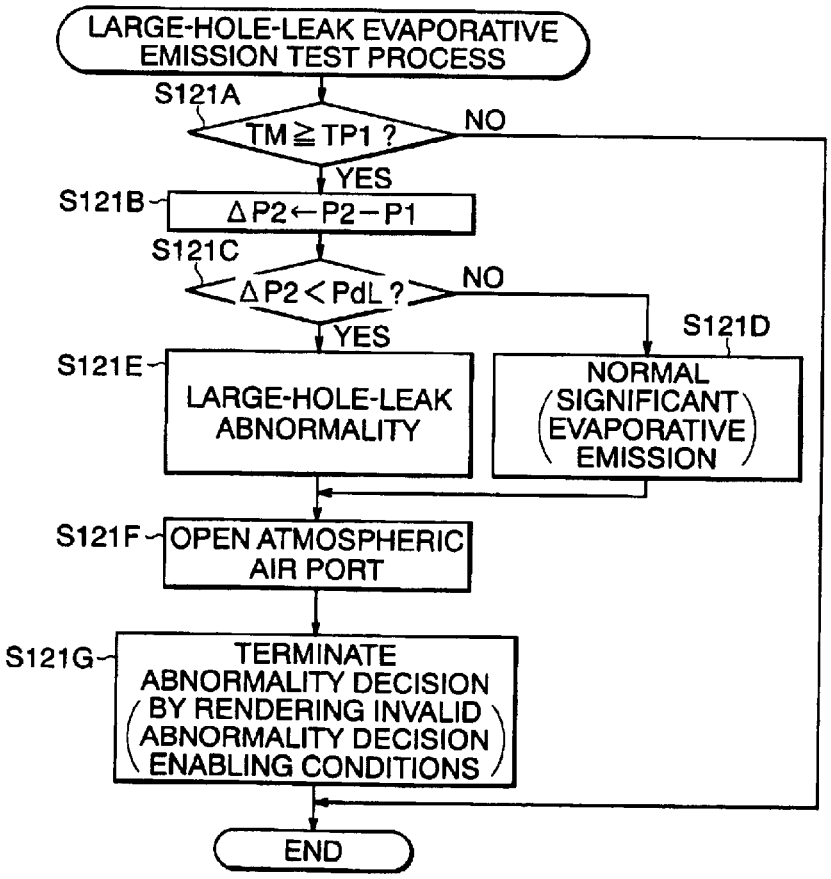
FIG. 6 is a flow chart specifically showing large-hole-leak evaporative emission test processing (step S121) shown in FIG. 2.

When it is decided at step S123A that the fuel tank pressure Pt is lower than the restored pressure level PA1 (i.e., if NO), indicating that the fuel tank pressure Pt close to the atmospheric pressure PA has not been restored yet, then the processing routine shown in FIG. 6 immediately comes to an end.

By contrast, when it is decided at step S123A that the fuel tank pressure Pt is equal to or higher than the restored pressure level PA1 (i.e., if YES), indicating that the fuel tank pressure Pt has been already restored to the preset level close to the atmospheric pressure level PA, then initialization processing for starting the large-hole-leak evaporative emission test is executed (step S123B).

More specifically, at step S123B, the timer TM is initialized for measuring the time lapse from the time point when the fuel tank has been hermetically closed approximately at the atmospheric pressure PA while the fuel evaporative emission control system is placed in the hermetically closed state by closing the atmospheric air port 11, so that the large-hole-leak evaporative emission test flag is set.

Subsequently, the fuel tank pressure Pt at the time point where the fuel evaporative emission control system is hermetically closed is stored as a value "P1" (step S123C), and the processing routine shown in FIG. 5 is terminated.

Next, referring to FIG. 6, description will be made of the large-hole-leak evaporative emission test processing (FIG. 2, step S121). FIG. 6 is a flow chart for specifically showing the large-hole-leak evaporative emission test processing step S121. As described previously, the large-hole-leak evaporative emission test processing step S121 is executed in the state where the fuel evaporative emission control system including the canister 9 is hermetically closed and where the fuel tank pressure Pt is close to or approximately equal to the atmospheric pressure PA.

Referring to FIG. 6, decision is first made as to whether or not the timer TM has reached the predetermined time TP1 (step S121A). When it is decided that TM<TP1 (i.e., if NO), this means that the predetermined time TP1 has not lapsed yet from the time point at which the fuel evaporative emission control system was hermetically closed at the fuel tank pressure level Pt close to the atmospheric pressure PA. In that case, the processing routine shown in FIG. 6 is immediately terminated.

By contrast, when it is decided at step S121A that TM>TP1 (i.e., if YES), this means that the preset or predetermined time TP1 has lapsed from the time point at which the fuel evaporative emission control system was hermetically closed at the fuel tank pressure level Pt close to the atmospheric pressure PA. In this case, a tank pressure difference ΔP2 between the current fuel tank pressure Pt (=P2), i.e., the fuel tank pressure after the lapse of the predetermined time TP1, and the preceding fuel tank pressure P1 (i.e., the fuel tank pressure at the time point when the timer measurement was started) is arithmetically determined (step S121B).

Subsequently, decision is made whether or not the tank pressure difference ΔP2 is smaller than an abnormal large-hole-leak pressure difference PdL (step S121C). When it is decided at step S121C that the tank pressure difference ΔP2 is equal to or greater than the abnormal large-hole-leak pressure difference PdL (i.e., if NO), it can be regarded that increase of the pressure due to the evaporative emission of the fuel is significant. Thus, it is determined that the fuel tank pressure Pt could not attain the target pressure level Po due to the evaporative emission of the fuel and hence the fuel evaporative emission control system is in the normal or healthy state (step S121D). Accordingly, the atmospheric air port 11 of the canister 9 is opened (step S121F).

By contrast, when it is decided at step S121C that ΔP2<PdL (i.e., if YES), it can then be regarded that the increase of the pressure caused due to the evaporative emission of the fuel is not so significant. Thus, it is determined that the abnormal large-hole leak takes place (step S121E). In this case, the atmospheric air port 11 of the canister 9 is opened (step S121F).

Finally, abnormality decision disable processing (i.e., processing for rendering the abnormality decision enabling conditions to be constantly invalid) is performed (step S121G). Then, the processing routine shown in FIG. 6 comes to an end.

Figure 7:
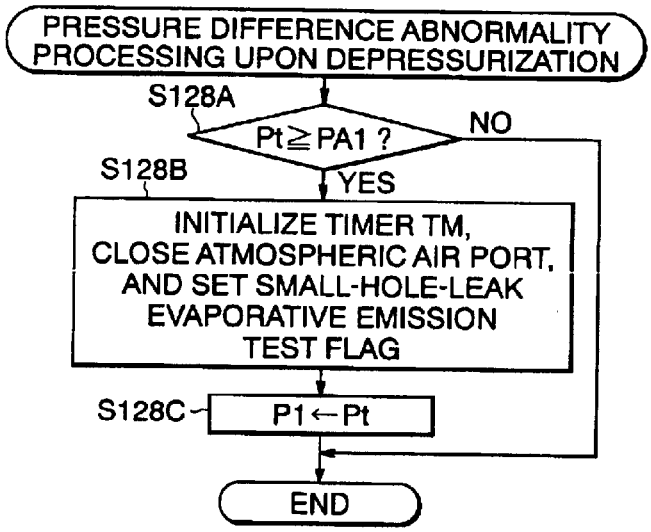
FIG. 7 is a flow chart specifically showing pressure-reduction-time pressure-difference-abnormality-time processing (step S128) shown in FIG. 2.

Next, referring to a flow chart shown in FIG. 7, description will be made of the pressure difference abnormality processing upon depressurization of FIG. 2 (step S128). Referring to FIG. 7, steps S128A to S128C correspond, respectively, to steps S123A to S123C described previously (see FIG. 5).

At first, at step S128A, decision is made as to whether or not the fuel tank pressure Pt has attained a level which is equal to or higher than the restored pressure PA1 in the state where the purge control valve 10 is closed with the atmospheric air port 11 being opened.

When it is decided at step S128A that Pt<PA1 (i.e., if NO), indicating that the fuel tank pressure Pt has not been restored yet to a level close to the atmospheric pressure PA. In that case, the processing routine shown in FIG. 7 is immediately terminated.

By contract, when it is decided at step S128A that Pt≧PA1 (i.e., if YES), indicating that the fuel tank pressure Pt has already been restored close to the atmospheric pressure PA, then initialization processing for starting the small-hole-leak evaporative emission test is performed (step S128B).

More specifically, at step S128B, the timer TM is initialized with the aim of measuring the time lapse of the hermetically closed state set approximately at the atmospheric pressure PA while the fuel evaporative emission control system is placed in the hermetically closed state by closing the atmospheric air port 11, and the small-hole-leak evaporative emission test flag is set.

Subsequently, the fuel tank pressure Pt at the time point when the hermetic closure state is set is stored as "P1" (step S128C), and the processing routine shown in FIG. 7 is terminated.

Figure 8:
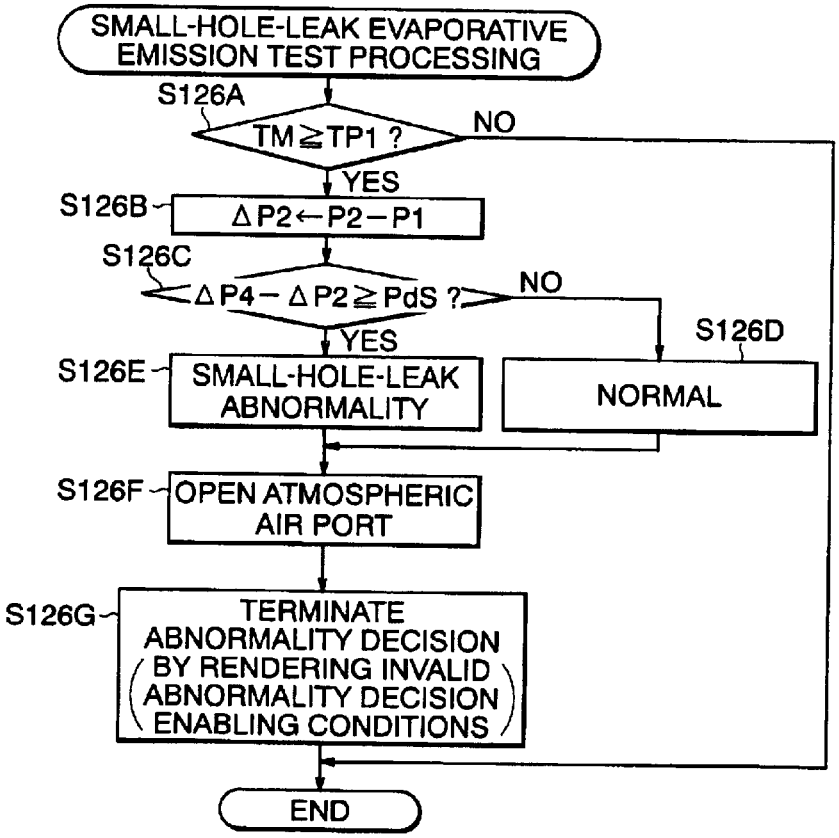
FIG. 8 is a flow chart specifically showing small-hole-leak evaporative emission test processing step (S126) shown in FIG. 2.

Next, referring to FIG. 8, description will be made of the small-hole-leak evaporative emission test processing of FIG. 2 (step S126). FIG. 8 is a flow chart specifically showing the small-hole-leak evaporative emission test processing step S126. In the figure, steps S126A to S126G correspond to steps S121A to S121G described above (see FIG. 6), respectively.

Referring to FIG. 8, decision is first made as to whether or not the timer TM has reached or exceeded a predetermined time TP1 (step S126A). When it is decided that TM<TP1 (i.e., if NO), this means that the predetermined time TP1 has not lapsed yet from the time point at which the fuel evaporative emission control system was hermetically closed in the state where the fuel tank pressure Pt is close to the atmospheric pressure PA. In that case, the processing routine shown in FIG. 8 is immediately terminated.

By contrast, when it is decided at step S126A that TM≧TP1 (i.e., if YES), this means that the predetermined time TP1 has lapsed from the time point at which the fuel evaporative emission control system was hermetically closed in the state where the fuel tank pressure Pt is close to the atmospheric pressure PA. Accordingly, the tank pressure difference ΔP2 between the current fuel tank pressure Pt (=P2) (after lapse of the predetermined time TP1) and the preceding fuel tank pressure P1 (measured at the time point when the timer operation was started) is arithmetically determined (step S126B).

Subsequently, a pressure difference ΔP between the tank pressure differences ΔP4 and ΔP2 (=ΔP4-ΔP2) is arithmetically determined. Then, decision is made as to whether or not the pressure difference ΔP is equal to or greater than an abnormal small-hole-leak pressure difference PdS (step S126C). When it is decided at step S126C that ΔP<PdS. (i.e., if NO), this means that a leak component is small, indicating the normal state (step S126D). Accordingly, the atmospheric air port 11 of the canister 9 is opened (step S126F).

On the other hand, when it is decided at step S126C that ΔP≧PdS (i.e., if YES), indicating that the leak component is large, abnormal small-hole leak is determined (step S126E). Then, the atmospheric air port 11 of the canister 9 is opened (step S126F).

In this case, the small-hole-leak abnormality is decided at step S126C by reference to the pressure difference ΔP derived by subtracting the tank pressure difference ΔP2 approximately at the atmospheric pressure (immediately after closing of the atmospheric air port) from the tank pressure difference ΔP4 in the negative pressure state (immediately after the interruption of the purge).

This is because only the actual leak component has to be checked by eliminating the influence of the evaporative emission of the fuel from the tank pressure difference ΔP4 in the negative pressure state, since the tank pressure difference ΔP2 approximately at the atmospheric pressure corresponds to the increment of pressure due to the evaporative emission of the fuel.

Finally, the abnormality decision processing is disabled (i.e., the abnormality decision enabling conditions are rendered to be constantly invalid) (step S126G), and the processing routine shown in FIG. 8 is terminated.

In this way, in the case where the fuel temperature TT is high and the fuel evaporative emission occurs easily in the fuel tank 8, it is determined that the abnormality decision enabling conditions are not validated, and the examination is prohibited. Accordingly, the excellent abnormality detection can be maintained without the erroneous detection.

Embodiment 2

Note that, in Embodiment 1 described above, the fuel temperature TT in the fuel tank 8 detected by the fuel temperature sensor 32 is used in the validity determination regarding the abnormality decision enabling conditions. However, a tank internal temperature TTN detected by a tank internal temperature sensor 33, or an outside air temperature TG detected by an outside air temperature sensor 31, may be used and compared with a comparison reference value.

Note that, the processing for determining whether the abnormality decision enabling conditions are validated is similar to the flow chart (see FIG. 3) mentioned above. The only variation is that the fuel temperature UT and the comparison reference value TTMON at step S101Z are replaced with the tank internal temperature TTN or the outside air temperature TG, and the comparison reference values corresponding to each of these, respectively.

In other words, just as in the case where the fuel temperature TT is high, in the case where the tank internal temperature TTN and the outside air temperature TG are high, the fuel evaporative emission readily occurs inside the fuel tank 8. Therefore, it is determined that the abnormality decision enabling conditions are not validated, thereby making it possible to decrease the possibility of the erroneous determination.

Embodiment 3

Note that, in Embodiment 1 described above, the absolute value of the fuel temperature TT is compared against the comparison reference value, to determine whether the abnormality decision enabling conditions are validated. However, it is also possible to compare a change in the fuel temperature TT with a comparison reference value to determine whether the abnormality decision enabling conditions are validated.

Figure 9:
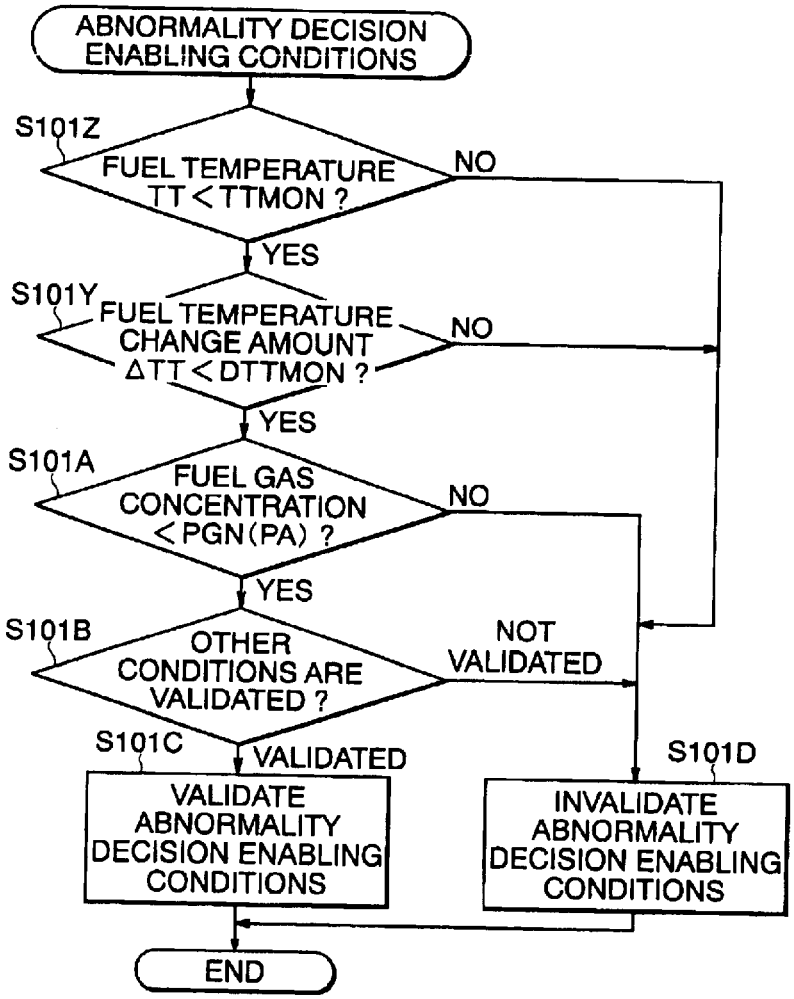
FIG. 9 is a flow chart specifically showing abnormality decision enabling condition processing (step S101) shown in FIG. 2, according to Embodiment 3 of the present invention.

Hereinafter, description will be made of Embodiment 3 of the present invention, in which a fuel temperature change ΔTT and the comparison reference value are compared. FIG. 9 is a flow chart showing processing of determining whether the abnormality decision enabling conditions are validated, according to Embodiment 3 of the present invention. In the validity determination processing for the abnormality decision enabling conditions, S101A through S101D and S101Z are similar to the above-mentioned flow chart (see FIG. 3). Only the comparison of the fuel temperature change ΔTT and a comparison reference value DTTMON is added at step S101Y.

In FIG. 9, the fuel temperature TT change amount ΔTT detected by the fuel temperature sensor 32 provided inside the fuel tank 8, is compared with the comparison reference value DTTMON, to determine whether or not the fuel temperature change amount is less than the comparison reference value DTTMON (step S101Y).

At step S101Y, if it is determined that the fuel temperature change amount is equal to or greater than the comparison reference value DTTMON (i.e., if NO), then the procedure advances to step S101D for determining whether the abnormality decision enabling conditions are not validated, and the processing routine shown in FIG. 9 is terminated.

Further, at step S101Y, if it is determined that the fuel temperature change amount is less than the comparison reference value DTTMO (i.e., if YES), then the procedure advances to step S101A for determining whether the other conditions are validated. The processing after step S101A is similar to FIG. 3, and detailed description is omitted here.

Accordingly, depending on the change in the fuel evaporative emission amount inside the fuel tank 8, in the state where the fuel temperature change ΔTT is great and easily influences the change in the fuel pressure inside the tank, it is determined that the abnormality decision enabling conditions are validated, and the abnormality examination is prohibited. Therefore, the possibility of the erroneous abnormality detection is further decreased, and the detection precision in the examination can be increased.

Embodiment 4

Note that, in Embodiment 3 described above, the change amount ΔTT of the fuel temperature in the fuel tank 8 detected by the fuel temperature sensor 32 is used in the validity determination regarding the abnormality decision enabling conditions. However, a tank internal temperature change amount ΔTTN detected by a tank internal temperature sensor 33, or an outside air temperature change amount ΔTG detected by an outside air temperature sensor 31, may be used and compared with a comparison reference value.

Note that, the processing for determining whether the abnormality decision enabling conditions are validated is similar to the flow chart (see FIG. 9) mentioned above. The only variation is that the fuel temperature change amount ΔTT and the comparison reference value DTTMON at step S101Y are replaced with the tank internal temperature change amount ΔTTN the outside air temperature change amount ΔTG, and the comparison reference values corresponding to each of these, respectively.

In other words, just as in the case where the fuel temperature change amount ΔTT is great, in the case where the tank internal temperature change amount ΔTTN and the outside air temperature change amount ΔTG are great, the change in the fuel evaporative emission amount inside the fuel tank 8 is great and can easily influence the tank pressure change. Therefore, under such conditions, it is determined that the abnormality decision enabling conditions are not validated, thereby making it possible to decrease the possibility of the erroneous determination.

Embodiment 5

Note that, in Embodiments 1 through 4 described above, in the condition validity determination based on the fuel gas concentration, the comparison reference values corresponding to a large-hole-leak abnormality and a small-hole-leak abnormality were not particularly taken into consideration. However, individual comparison reference values for the fuel temperature, the tank internal temperature, and the outside air temperature may be set for the large-hole-leak abnormality and the small-hole-leak abnormality.

Figure 10:
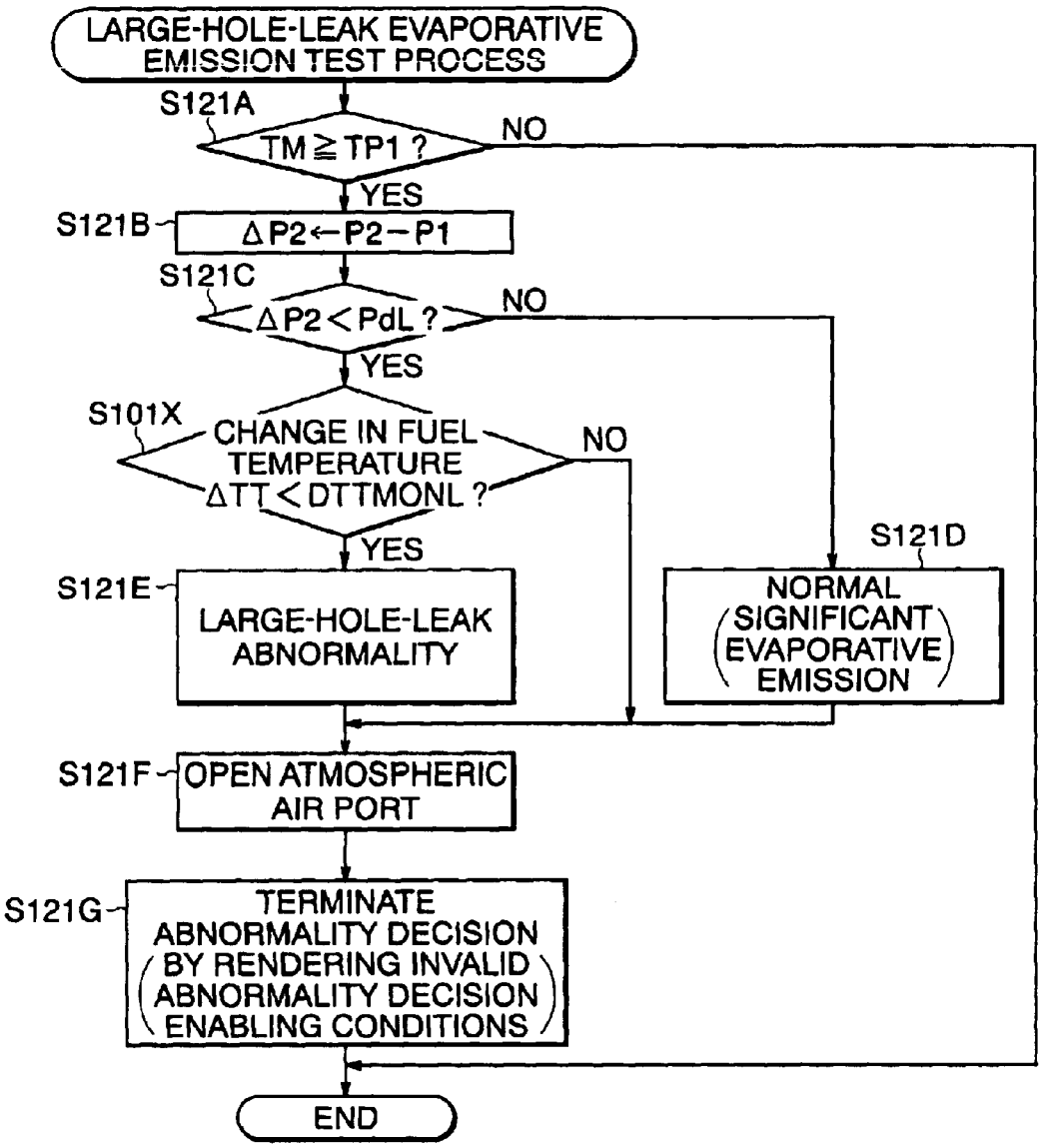
FIG. 10 is a flow chart specifically showing large-hole-leak evaporative emission test processing according to Embodiment 5 of the present invention.
Figure 11:
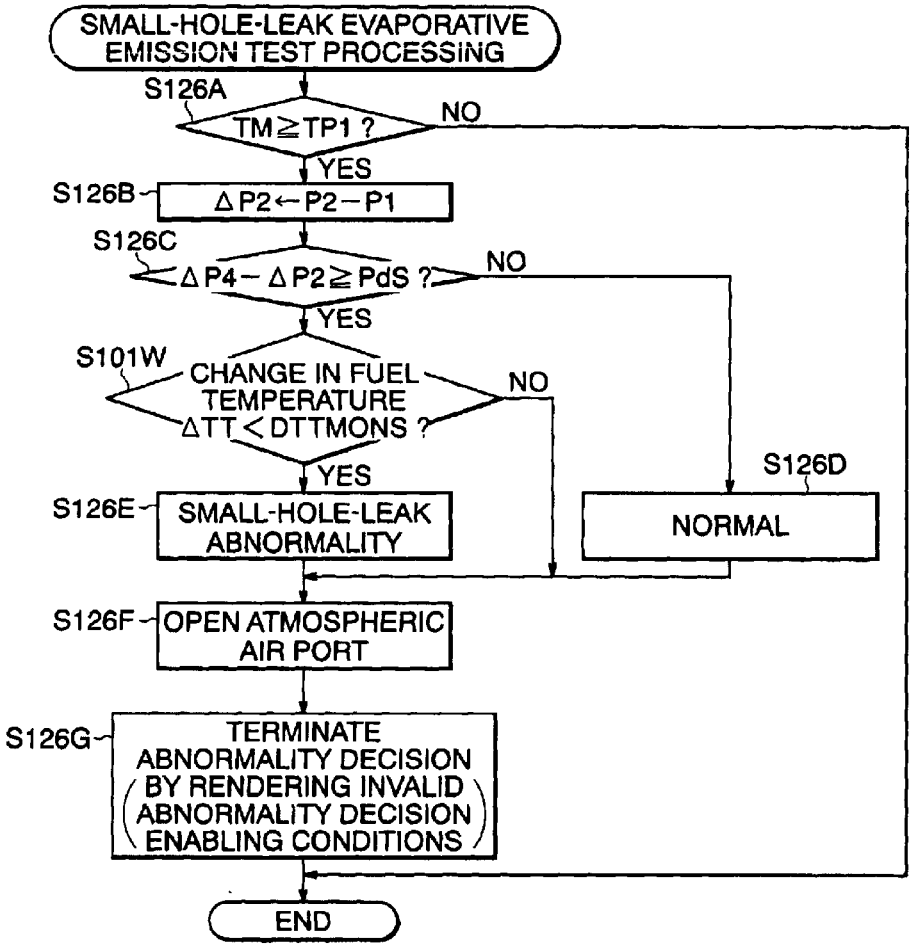
FIG. 11 is a flow chart specifically showing small-hole-leak evaporative emission test processing according to Embodiment 5 of the present invention.

Below, description will be made of Embodiment 5 of the present invention, in which the comparison reference value is individually set depending on the determined abnormal states. FIGS. 10 and 11 are flow charts showing a large-hole-leak evaporative emission test processing and a small-hole-leak evaporative emission test processing, respectively, according to Embodiment 5 of the present invention.

In FIGS. 10 and 11, steps S121A to S121G and steps S126A to S126G are similar to those described above (by reference to FIGS. 6 and 8), respectively. Accordingly, repeated description in detail of these steps will be omitted. Further, each of steps S101X and S101W shown in FIGS. 10 and 11 corresponds to step S101Y of the abnormality decision enabling condition processing procedure described heretofore (by reference to FIG. 9).

The comparison reference value DTTMONL employed for testing the large-hole-leak in FIG. 10 is a value which is set greater than the comparison reference value DTTMONS employed for testing the small-hole-leak in FIG. 11. This is because in the case of the large-hole-leak, the evaporative emission fuel generation amount change caused by the fuel temperature change ΔTT has a smaller effect on the fuel tank pressure Pt, and thus step S121E in FIG. 10 is arranged such that the large-hole-leak abnormality is easily determined.

On the other hand, in the case of the small-hole-leak, the effect of the change in the evaporative emission fuel generation amount caused by to the fuel temperature change ΔTT has a large effect on the fuel tank pressure Pth. Therefore, the small-hole-leak abnormality decision at step S126E in FIG. 11 is prohibited, to prevent the erroneous determination of the abnormality.

At step S101X in the large-hole-leak evaporative emission test processing shown in FIG. 10, the comparison reference value DTTMONL employed for testing the relatively larger large-hole-leak is used, and if it is determined that the fuel temperature change is sufficiently small (i.e., if YES), then the procedure advances to step S121E to determine the large-hole-leak abnormality. At this time, since the comparison reference value DTTMONL is large, the abnormality is determined under less stringent conditions regarding the fuel temperature change.

On the other hand, when it is decided at step S101X that the fuel temperature change amount is equal to or greater than the comparison reference value DTTMONL (i.e., if NO), the processing skips step S121E to proceed to step S121F where the atmospheric air port 11 of the canister 9 is opened. Additionally, when the decision at step S101X results in "NO", the processing does not proceed to step S121D to determine the normal state. In other words, neither the normal state nor the abnormal state is determined. The final determination as to the normal or abnormal state is left to the succeeding abnormality decision procedure.

When it is decided at step S101W that the fuel temperature change amount is smaller than the comparison reference value DTTMONS (i.e., if YES), the processing proceeds to step S126E to determine the small-hole-leak abnormality. In this case, because the comparison reference value DTTMONS is set relatively small, abnormality concerning the fuel temperature change is determined on the stringent conditions in order to exclude the possibility of erroneous determination of the small-hole-leak abnormality.

On the other hand, when it is decided at step S101W that the fuel temperature change amount is equal to or greater than the comparison reference value DTTMONS (i.e., if NO), the processing skips step S126E to proceed to step S126F where the atmospheric air port 11 is opened. In this conjunction, it is also to be noted that even in the case where the decision step S101W results in "NO", the processing does not proceed to step S126D for determining the normal state, but the final determination of the normal or abnormal state is left to the result of the succeeding abnormality decision procedure.

In this manner, the large-hole-leak abnormality can positively be determined substantially without fail by setting distinctively the comparison reference values, respectively, in conformance with the abnormal states (i.e., the large-hole-leak abnormality and the small-hole-leak abnormality) of the fuel evaporative emission control system which can be estimated on the basis of the fuel tank pressure Pt. Moreover, erroneous determination can be prevented by conducting strictly the determination of the small-hole-leak abnormality.

More specifically, the favorable abnormality detection performance can be ensured and sustained by adopting the appropriate or proper comparison reference value which is determined by taking into account the susceptibility of the fuel to the evaporative emission within the fuel tank in dependence on the degree of a leak abnormality (which is brought about by various causes such as removal of the cap from the fuel tank 8, bending, collapsing or dropout of the purge passage pipe) in the fuel evaporative emission control system.

Embodiment 6

Note that, in Embodiments 1 through 5 described above, the fuel temperature, the tank internal gas temperature, the outside air temperature, and the comparison reference values for the temperature changes of each of these are fixed data. However, the comparison reference values may be changed in dependence on the atmospheric pressure PA.

FIGS. 12 and 13 are explanatory diagrams showing comparison reference values TTMON(PA) and DTTMON (PA) which are set changeably, according to Embodiment 6 of the present invention. FIG. 12 shows the comparison reference value TTMON(PA) for the fuel temperature, which is set changeably in dependence on the atmospheric pressure PA. FIG. 13 shows the comparison reference value DTTMON(PA) for the fuel temperature change amount, which is set changeably in dependence on the atmospheric pressure PA.

In this way, by using a parameter to set the comparison reference values, the determination of whether or not the abnormality decision enabling conditions are validated can be made based on more precise comparison reference values.

In accordance with the embodiment described above, the abnormality decision is prohibited corresponding to the detected value of at least one of the fuel temperature, the tank internal temperature, and the outside air temperature. Therefore, the more reliable abnormality detecting apparatus for the fuel evaporative emission control system can be obtained.

Further, the abnormality decision is prohibited when at least one of the fuel temperature, the tank internal temperature and the outside air temperature is changed by a predetermined value or more. Therefore, the more reliable abnormality detecting apparatus for the fuel evaporative emission control system can be obtained.

Further, a plurality of the prohibition condition determination values (TTMON, DTTMON, DTTMONS, DTTMONL) used for each measuring process are individually set in dependence on a plurality of abnormality conditions (specifically, the large-hole-leak, the small-hole-leak, an extremely-small-hole-leak) which are predicted based on the fuel tank pressure. Then, the prohibition condition determination values are switched to prohibit the abnormality decision. Therefore, the more reliable abnormality detecting apparatus for the fuel evaporative emission control system can be obtained.

Further, the prohibition condition determination values used for each measuring process are individually set for process in measuring the fuel tank pressure (the process up to reaching a pressure reduction target value, a pressure reduction time sealing process, a small-hole-leak evaporative emission test process, a large-hole-leak evaporative emission test process) in dependence on the plurality of abnormality conditions (specifically, the large-hole-leak, the small-hole-leak, the extremely-small-hole-leak) which are predicted based on the fuel tank pressure. Further, the abnormality decision is prohibited by switching the prohibition condition decision values (TTMON, DTTMON) in dependence on the process for measuring the tank pressure, according to the plurality of abnormality conditions. Therefore, the more reliable abnormality detecting apparatus for the fuel evaporative emission control system can be obtained.

Further, the prohibition condition decision value of at least one of the fuel temperature, the tank internal temperature, and the outside air temperature is compensated in accordance with the atmospheric pressure. Therefore, the more reliable abnormality detecting apparatus for the fuel evaporative emission control system can be obtained.

As described above, according to the present invention, the abnormality decision of the evaporative emission control system is prohibited corresponding to the detected value of at least one of the fuel temperature, the tank internal temperature, and the outside air temperature. Therefore, the more reliable abnormality detecting apparatus for the fuel evaporative control system can be obtained.

What is claimed is:

1. An abnormality detecting apparatus for detecting abnormality in a fuel evaporative emission control system, comprising:

sensor means for detecting operation states of an internal combustion engine;

a canister disposed at an intermediate location of a purge passage communicating a fuel tank providing fuel to the internal combustion engine and an air intake pipe of the internal combustion engine with each other, for adsorbing fuel gas generated in the fuel tank;

an atmospheric air port provided to the canister and opened to an atmosphere side;

a purge valve disposed at an intermediate position between the canister and the air intake pipe; and fuel evaporative emission control means for preventing the evaporative emission of the fuel by controlling opening/closing of the purge valve depending on the operation state of the internal combustion engine, and introducing fuel gas adsorbed by the canister into the air intake pipe as occasion requires, wherein the sensor means includes:

one of intake air amount detecting means for detecting an intake air amount as a load state of the internal combustion engine, and intake air pipe pressure detecting means for detecting an intake air pressure and atmospheric pressure detecting means for detecting an atmospheric pressure;

at least one of outside air temperature detecting means for detecting an outside air temperature, fuel temperature detecting means for detecting a fuel temperature inside the fuel tank, and tank internal temperature detecting means for detecting a gas temperature inside the fuel tank; and fuel tank pressure detecting means for detecting a pressure within the fuel tank as a fuel tank pressure, wherein the fuel evaporative emission controlling means includes:

atmospheric air port closing means for closing the atmospheric air port;

hermetically closing means for hermetically closing both the purge control valve and the and the atmospheric air port to thereby put the overall fuel evaporative emission control system in a hermitically sealed state;

abnormality decision enabling condition detecting means for detecting validity of an abnormality decision enabling condition of the fuel evaporative emission control system, based on the operation state of the internal combustion engine;

purge rate adjusting means for regulating a purge rate by controlling an opening degree of the purge control valve depending on the air intake pipe pressure when the abnormality decision enabling condition is valid; and abnormality detecting means for detecting abnormality of the fuel evaporative emission control system, based on the fuel tank pressure at the time when the abnormality decision enabling condition is valid, wherein the abnormality decision enabling condition detecting means includes condition validation limiting means for prohibiting the abnormality decision, in dependence on at least one of the fuel temperature, the tank internal temperature, and the outside air temperature.

2. An abnormality detecting apparatus for a fuel evaporative emission control system according to claim 1, wherein the condition validation limitation means prohibits an abnormal determination in a case where at least one of the fuel temperature, the tank internal temperature, and the outside air temperature detection means is changed by a value equal to or greater than a predetermined value.

3. An abnormality detecting apparatus for an fuel evaporative emission control system according to claim 1, wherein the condition validation limiting means individually sets a plurality of prohibition condition decision values corresponding to a plurality of abnormal states predicted based on the fuel tank pressure, and switches the plurality of prohibition condition decision values in dependence on the plurality of abnormal states.

4. An abnormality detecting apparatus for a fuel evaporative emission control system according to claim 1, wherein the condition validation limitation means sets the prohibition condition decision value for each fuel tank pressure measuring process, according to the predicted plurality of abnormal states.

5. An abnormality detecting apparatus for a fuel evaporative emission control system according to claim 1, wherein the condition validation limitation means compensates the prohibition condition decision value of at least one of the fuel temperature, the outside air temperature and the tank internal temperature detection means, in accordance with atmospheric pressure, to prohibit an abnormal determination.

* * * * *